United States Patent [19]

Kamimura et al.

[11] Patent Number: 4,826,336

[45] Date of Patent: May 2, 1989

[54] PRINTING AND WEB FEED APPARATUS IN A CASH REGISTER OR THE LIKE

[75] Inventors: Masahiro Kamimura; Akehiro Ono; Susumu Misu; Junji Nakahara, all of Nagoya, Japan

[73] Assignee: Brother Kogyo Kabushiki Kaisha, Nagoya, Japan

[21] Appl. No.: 125,229

[22] Filed: Nov. 20, 1987

[30] Foreign Application Priority Data

Nov. 22, 1986 [JP] Japan ..... 61-279246

[51] Int. Cl.[4] ..... B41J 15/22

[52] U.S. Cl. ..... 400/607; 400/322; 400/584; 400/607.3

[58] Field of Search ..... 400/313, 314, 314.1, 400/314.6, 315, 320, 322, 328, 568, 582, 584, 586, 605, 607, 607.3, 608.2

[56] References Cited

U.S. PATENT DOCUMENTS 4,229,113 10/1980 Anderson et al. ..... 400/607
4,324,500 4/1982 Moon et al. ..... 400/568
4,388,007 6/1983 Meier et al. ..... 400/314
4,569,611 2/1986 Watanabe et al. ..... 400/624

FOREIGN PATENT DOCUMENTS 86771 7/1981 Japan ..... 400/584

*Primary Examiner*—David A. Wiecking
*Attorney, Agent, or Firm*—Jones, Tullar & Cooper

[57] ABSTRACT

Disclosed herewith is a printing apparatus for use in a cash register or the like, in which a receipt sheet and a journal sheet are disposed in parallel to each other on a platen that defines a print line and a movable printing body including a printing head which reciprocates along the platen to perform its printing operation selectively on the receipt and journal sheets in regions respectively facing these sheets. The line-feeding operation of the receipt sheet is controlled to be carried out when the printing head is located at least partially in the region facing the receipt sheet, whereby the line-feeding of the receipt sheet can be performed without interfering with the movement of the movable printing body.

5 Claims, 4 Drawing Sheets

PRINTING AND WEB FEED APPARATUS IN A CASH REGISTER OR THE LIKE

BACKGROUND OF THE INVENTION

The present invention relates to a printing apparatus for use in a cash register or the like, which has first and second sheets, such as a receipt sheet and a journal sheet, disposed in parallel to each other on a platen and line-feeds these sheets at the time of printing, and more particularly, to an improved printing apparatus for use in a cash register, which sets the timing of line-feeding the receipt sheet in relation to the position of a movable printing body.

For instance, in a printing apparatus for a cash register, a receipt sheet and a journal sheet are provided in parallel to each other in the running direction of a printing head of a movable printing body, a narrow and elongated printing ink ribbon is set laterally over these sheets, and the movable printing body moves reciprocatably along the ribbon. At the time of printing, the movable printing body reciprocatably moves from the receipt sheet to the journal sheet and during this reciprocation, the printing head alternately prints data on the receipt and journal sheets through the ribbon. At this time, in line-feeding the receipt sheet, the receipt sheet moves in its feeding direction by a predetermined line pitch at a timing when the movable printing body returns from one side-edge of the journal sheet to the other side-edge which is adjacent to the receipt sheet.

However, if the line-feeding of the receipt sheet is interrupted by, for example, an operator's hand accidentally touching the upper portion of the receipt sheet while the line-feeding of the receipt sheet is being carried out, the receipt sheet would be bent toward the movable printing body. With this state, when the movable printing body returns to the position to face the receipt sheet, the printing body hits one edge of the receipt sheet. Due to the stress applied at that edge, the receipt sheet would be wrinkled and possibly torn, thus causing undesirable sheet jamming.

Such a problem is likely to occur because the receipt sheet needs to be line-fed to the outside of the printing apparatus so that an operator may accidentally touch the moving sheet to interrupt the line-feeding of the sheet. With respect to the journal sheet, by way of contrast, it is not fed out but is wound up inside the printing apparatus, so that no such problem occurs. Since the movable printing body facing the printing sheet laterally moves at a close distance to the sheet disposed on a platen, if the sheet is separated from the platen, the sheet is likely to come into the running path of the printing head, thus interrupting the movement of the movable printing body.

SUMMARY OF THE INVENTION

With the above in mind, it is an object of this invention to provide a printing apparatus for use in a cash register or the like, which releases interruption of a first sheet, e.g., a receipt sheet, against a movable printing body even when the line-feeding operation of the first sheet is interrupted for some reason, thus ensuring the prevention of the sheet from being wrinkled, torn or jammed up.

In order to achieve the above object, a printing apparatus according to this invention is provided with control means which controls line-feeding means for a first sheet such as a receipt sheet in relation with the moving position of a movable printing body so that the line-feeding of the first sheet starts when the movable printing body is located at least partially in a first region facing the first sheet.

With this design, it is assured that the movable printing body can avoid hitting the first sheet, particularly its edge portion. Therefore, if the line-feeding of the first sheet is interrupted for some reason, the mutual interruption between the movable printing body and the sheet does not occur, thus overcoming the common conventional problem of jamming up or tearing up the sheet.

These and other aspects and advantages of the present invention will be described in more detail below with reference to the accompanying drawings.

DESCRIPTION OF THE PREFERRED EMBODIMENT

Figure 1:
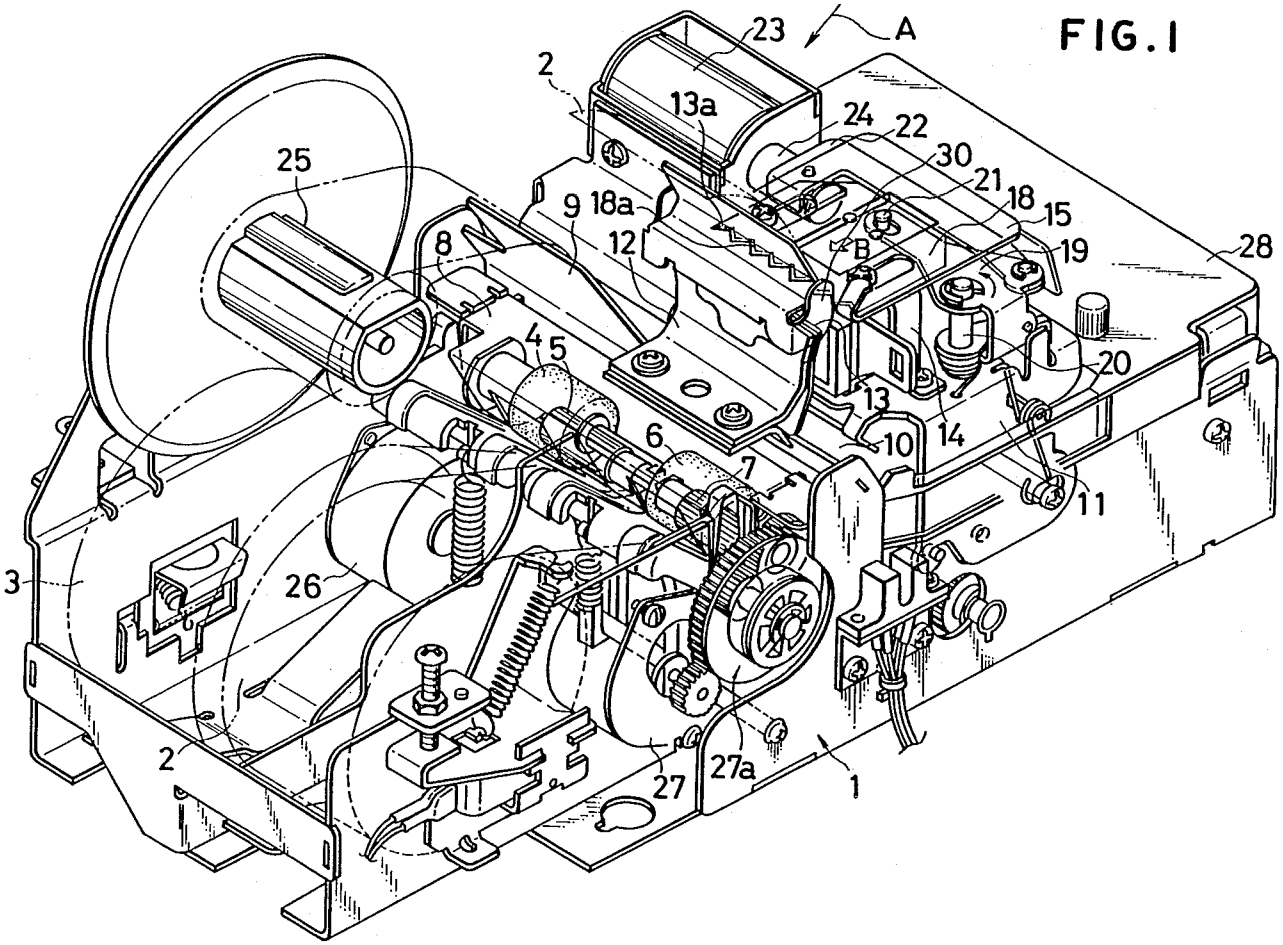
FIG. 1 is an overall perspective view of a cash register provided with a printing apparatus according to this invention, with a receipt sheet and a journal sheet being indicated by two-dotted chain lines.

FIG. 1 is an overall perspective view of a cash register provided with a printing apparatus according to this invention. As indicated by two-dotted chain lines, a receipt sheet 2 and journal sheet 3 are disposed in a rolled manner in a rectangular assembly frame 1 at its rear portion. At the center portion of the assembly frame 1 are rotatably disposed two pairs of rollers 4 and 5 and 6 and 7, which pairs respectively abut on the receipt sheet 2 and journal sheet 3. Further, an elongated rectangular cover 8 is provided on the assembly frame 1 to cover these roller pairs 4, 5 and 6, 7. At the front of the cover 8 is disposed a plate-shaped platen 9, which is bridged between the right and left walls of the assembly frame 1 and has its front face disposed nearly vertically. This platen 9 supports the receipt sheet 2 and journal sheet 3, which are fed by the roller pairs 4, 5 and 6, 7 to the front of the platen 9 passing thereunder, in parallel and adjacent to each other along the front face of the platen 9.

A support member 11 having a reversed-U shape as viewed from the front and rear directions is provided over the right and left side walls at the front of the platen 9 at a distance 10 therefrom.

At the top of the platen which faces the receipt sheet 2, an attachment plate 12 having an L-shape as viewed from its side is provided, and a plate 13 having a fixed blade **13*a* at its top is fixed to the front of the attachment plate 12. The front face of the plate 13 rises, like that of the platen 9, nearly vertically but above the platen 9. The top of the attachment plate 12 is attached with a cover 30 that covers the fixed blade 13*a***.

A rectangular support plate 15 is horizontally mounted through a pair of legs 14 on the support member 11. Under the support plate 15 is disposed a plate-shaped movable blade 18 having a blade portion 18*a*, which is reciprocatable in the directions toward and away from the fixed blade 13*a*. This blade 18 together with the fixed blade 13*a* constitutes a sheet cutting mechanism. Also under the support plate 15 is provided a drive plate 19 having its one end rotatably pivoted on a vertical shaft 20. The other end of the drive plate 19 is pivotally coupled to the movable blade 18 through a pin 21. The drive plate 19 is also coupled to a plunger 24 of an electromagnetic solenoid 23 through a link 22.

The journal sheet 3 is fed by rollers 4 and 5 driven by a first motor 26 via a gear mechanism (not shown), passing between these rollers 4 and 5 toward the front of the platen 9 and is then taken up on a take-up cylinder portion 25. The receipt sheet 2 is fed upward by rollers 6 and 7 driven by a second motor 27 via a gear mechanism 27*a*, passing between these rollers 6 and 7 and then passing the fronts of the platen 9 and the plate 13 in that order, and is then properly cut by the cutting mechanism constituted by the fixed blade 13*a* and the movable blade 18.

Figure 2:
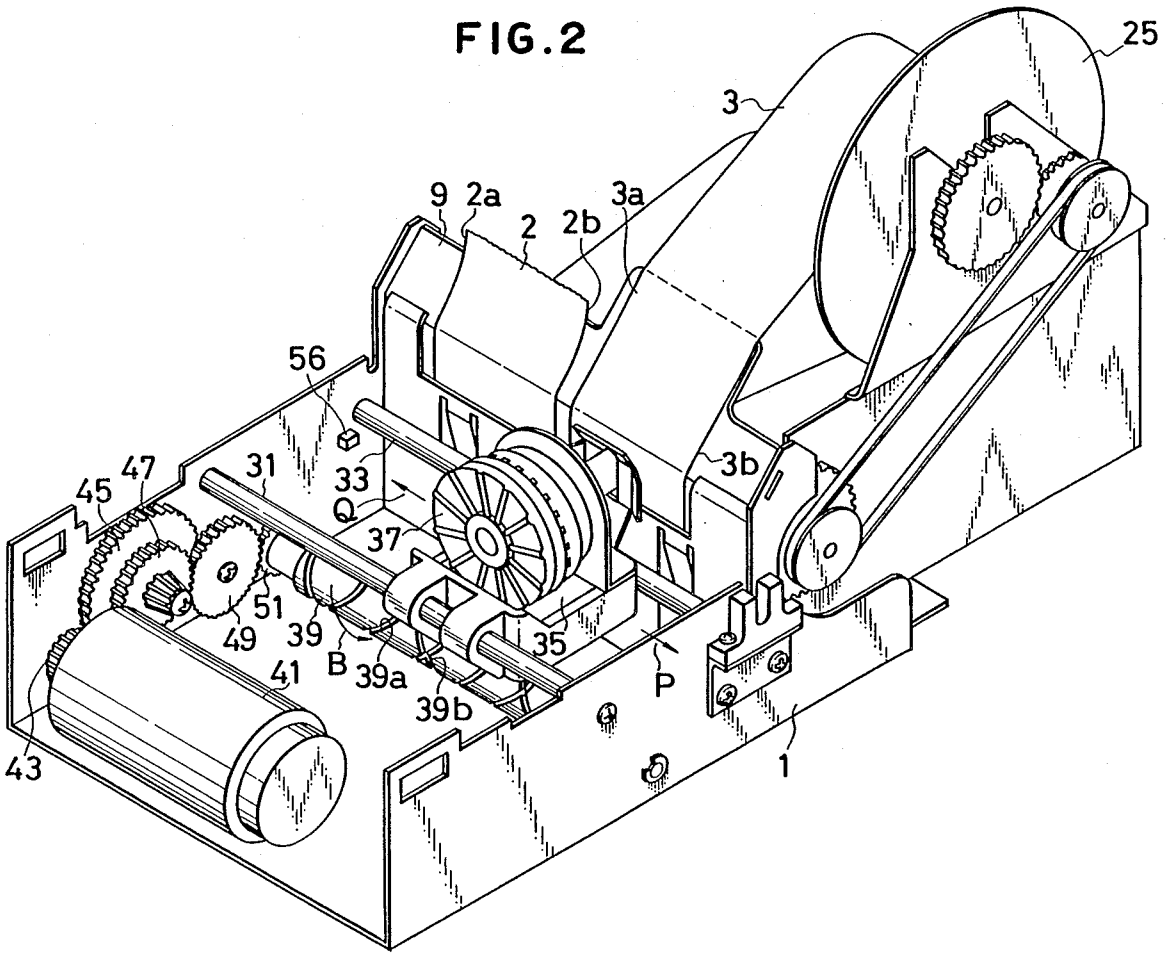
FIG. 2 is an exploded perspective view of a printing mechanism assembly mounted in the cash register shown in FIG. 1, as viewed from the direction of an arrow A of FIG. 1.

As shown in FIG. 2, under the support member 11 are guide shafts 31 and 33 which are arranged in parallel to each other and are bridged between both side walls of the assembly frame 1. A carriage 35 having a printing head 37 mounted thereon is supported on these guide shafts 31 and 33 slidably in the lateral direction. The carriage 35 and printing head 37 constitutes a movable printing body. A feed shaft 39, disposed in parallel to the guide shafts 31 and 33, is formed with endless spiral grooves 39*a* and 39*b* whose spiral directions are opposite to each other and in which a follower (not shown) provided on the carriage 35 is inserted. The feed shaft 39 is rotated in the direction of an arrow B by a motor 41 through gear mechanisms 43, 45, 47, 49 and 51, and the carriage 35 laterally reciprocates along the platen 9 by the mutual engagement of the follower and the spiral grooves 39*a* and 39*b*.

An ink ribbon exposed from a ribbon cassette 28 (FIG. 1) comes between the printing head 37 and the receipt sheet 2 and the journal sheet 3 and stretches between these two sheets. The printing head 37 prints data on these two sheets 2 and 3 through the ink ribbon.

In FIG. 2 the ribbon cassette 28 and the ribbon are omitted for diagrammatic simplicity.

The printing head 37 in this embodiment is of an impact wire dot type. This printing head may be of a thermal transfer type and naturally needs no ink ribbon in this case.

Figure 3:
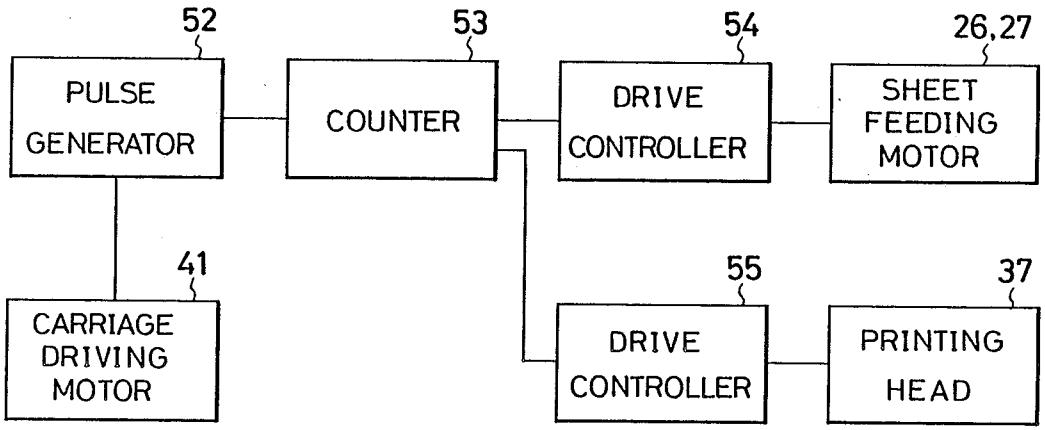
FIG. 3 is a block diagram of a drive control mechanism of the printing apparatus.

FIG. 3 is a block diagram illustrating the electric control mechanism for the printing apparatus. Pulses 52*a* (FIG. 4) generated from a pulse generator 52 at a predetermined cycle are supplied to the motor 41 to move the carriage 35. A counter 53 counts the pulses 52*a*. A position sensor 56 is provided at one end of the moving range of the carriage 35, for example, at the left end in FIG. 2 to detect the left position (i.e., home position) of the carriage 35. The counter 53 is designed to start counting the pulses when the carriage 35 starts moving toward the right or the forward direction indicated by an arrow P from the home position and its position cannot be detected by the sensor 56.

The printing head 37 moves through a first region that is from the left edge 2*a* to the right edge 2*b* of the receipt sheet 2 in FIG. 2, during a period between pulses T5 and T181, and moves through a second region that is from the left edge 3*a* to the right edge 3*b* of the journal sheet 3, during a period between pulse numbers T225 and T401. A drive controller 55 for the printing head 37 receives a count signal from the counter 53 and produces a print enable signal 55*a* during each of the periods corresponding to the first and second regions. In response to this print enable signal 55*a*, the printing head 37 selectively and sequentially prints externally-received print data on the receipt sheet 2 and the journal sheet 3. The signal 55*a* may have a width narrower than the one shown in FIG. 4.

The printing head 37 can perform its printing operation on the receipt sheet 2 when it is located, facing the sheet 2, in the first region defined by both edges 2*a* and 2*b* of the sheet 2.

Between the pulses numbers T5 and T181, a drive controller 54 for the sheet-feeding motors 26 and 27 receives the count signal from the counter 53 and outputs a feed signal 54*a* to the motor 26 to line-feed the journal sheet 3 by a predetermined pitch. The signal 54*a* may have a width narrower than the one shown in FIG. 4.

Figure 4:
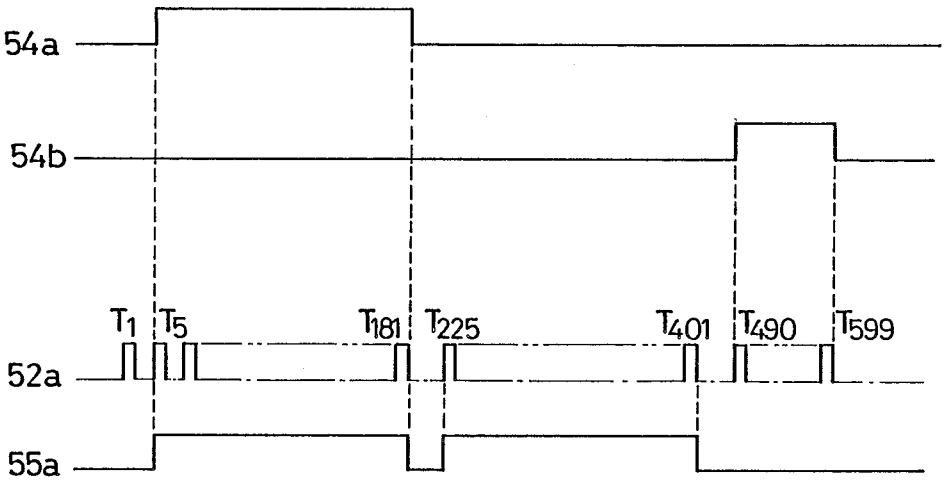
FIG. 4 is a timing chart illustrating a linefeeding operation performed in relation between receipt and journal sheets and a printing head laterally reciprocating over these sheets.

After completing a printing operation on the journal sheet 3, the printing head 37 starts moving in the direction indicated by an arrow Q in FIG. 2 by means of the feed shaft 39. The printing head 37 passes the boundary between the journal sheet 3 and the receipt sheet 2, namely, the boundary between the first and second regions, and faces the receipt sheet 2 at the right edge 2*b* thereof that is close to the journal sheet 3. A period between pulses T490 and T599 is what the printing head 37 requires to move to the left edge 2*a* of the receipt sheet 2 starting from the right edge 2*b*. During this period, the drive controller 54 sends a feed signal 54*b* to the receipt-sheet feeding motor 27 which in turn starts line-feeding the receipt sheet 2 by a predetermined pitch. The width of the signal 54*b* may be narrower than what is shown in FIG. 4.

As described above, the receipt sheet 2 is line-fed at the time of printing when the printing head 37 in its return motion is at least partially in the first region between the left edge 2*a* and right edge 2*b* of the sheet 2, i.e., when the printing head 37 faces the receipt sheet 2. Consequently, even when the operator accidentally touches the receipt sheet 2 and interrupts its line-feeding operation, unlike in the case of the prior art, the printing head can avoid hitting one edge (2*b*) of the receipt sheet 2 because at that time the head 37 has already passed the right edge 2*b* of the receipt sheet 2. This prevents wrinkling or tearing of the receipt sheet 2 due to such a line-feed interruption, thus preventing the otherwise possible occurrence of sheet jamming.

When the line-feeding of the receipt sheet 2 is interrupted after the printing head 37 moving in the return direction Q passes the right edge 2*b* of the receipt sheet 2, the sheet 2 would be bent toward the head 37, thus abutting on the head. However, this abutment does not influence the movement of the head 37, nor does it cause jamming or tearing up of the sheet.

The pulse generator 52 used in the above embodiment may be replaced by an encoder which is linked to the shaft of the carriage-moving motor 41 and produces a pulse signal with a predetermined cycle so as to serve as a pulse generator.

Needless to say, application of the present invention is not limited to a printing apparatus for a cash register; this invention can apply as well to a printing apparatus for issuing park tickets, order-in-line tickets or bills.

The present invention, when reduced to practice, can be modified in various manners within the scope and spirit of the invention.

What is claimed is:

1. A printing apparatus comprising:

an assembly frame;

platen means, supported on said assembly frame, for supporting first and second sheets in parallel and adjacent to each other, said first sheet having a first edge and a second edge opposite to the first edge thereof, said second sheet having a first edge close to the second edge of the first sheet and a second edge opposite to the first edge thereof;

a movable printing body, reciprocatably supported on said assembly frame along a print line defined by said platen means, for performing a printing operating selectively on said first and second sheets in a first region which is a space facing said first sheet from the first edge to the second edge thereof along said print line and in a second region which is a space facing said second sheet from the first edge to the second edge thereof along said print line, during a reciprocative motion of said movable printing body in forward and return strokes;

movable-printing body moving means for moving said movable printing body along said print line;

first feeding means for line-feeding said first sheet in a direction substantially perpendicular to said print line;

second feeding means for line-feeding said second sheet in a direction substantially perpendicular to said print line; and control means for operating said first feeding means to line-feed said first sheet each time said movable printing body passes said second edge of the first sheet close to said first edge of the second sheet in the return stroke to said first region from said second region so as to be located at least partially in said first region after executing the printing operation in the forward stroke in said first and second regions, whereby possible mutual interference between the movable printing body and the first sheet is avoided.

2. The printing apparatus according to claim 1, wherein said first sheet is a receipt sheet and said second sheet is a journal sheet.

3. The printing apparatus according to claim 1, wherein said control means includes a pulse generator for generating pulses with a predetermined period and a counter for counting said pulses from said pulse generator, and wherein said movable-printing-body moving means is driven by said pulses and said movable printing body is moved along said print line from a predetermined reference position in accordance with a number of said pulses, whereby a positional relationship between said movable printing body and at least one of said first and second regions is detected.

4. The printing apparatus according to claim 3, wherein said control means has means for operating said first feeding means to thereby line-feed said first sheet when said counter counts a predetermined number of pulses from said pulse generator.

5. The printing apparatus according to claim 4 wherein said control means has another means for operating said second feeding means to thereby line-feed said second sheet when said movable printing body is located at least partially in said second region in the forward stroke.

* * * * *